United States Patent [19]

Nakajima et al.

[11] Patent Number: 5,052,480

[45] Date of Patent: Oct. 1, 1991

[54] PIPE FOR COOLANT CONDENSER

[75] Inventors: Ichio Nakajima; Tsuneo Kousaka; Noboru Okada, all of Isezaki, Japan

[73] Assignee: Yuugen Kaisha Marunaka Seisakusho, Gunma, Japan

[21] Appl. No.: 517,353

[22] Filed: May 1, 1990

[30] Foreign Application Priority Data

Jul. 14, 1989 [JP] Japan ..... 1-83194[U]

[51] Int. Cl.[5] ..... F28D 1/02

[52] U.S. Cl. ..... 165/153; 165/173

[58] Field of Search ..... 165/153, 173, 176

[56] References Cited

U.S. PATENT DOCUMENTS 4,881,594 11/1989 Beamer et al. ..... 165/173

FOREIGN PATENT DOCUMENTS 1350811 12/1962 France .

*Primary Examiner*—Ronald C. Capossela

*Attorney, Agent, or Firm*—Bauer & Schaffer

[57] ABSTRACT

A header pipe for an automobile coolant condenser having a W-shaped profile in longitudinal cross section such that the projecting portions of the profile makes two-point contact with the ends of the corrugated fins.

3 Claims, 3 Drawing Sheets

PIPE FOR COOLANT CONDENSER

FIELD OF THE INVENTION

This invention relates to the construction of header pipes for coolant condensers used for automobile air conditioners.

PRIOR ART

The prior art air conditioner, as seen in FIG. 4, has header pipes A and C of like structure, each of which is divided lengthwise by partitioning plates E. The header pipes A and C each have a plurality of slots F for receiving heat exchange tubes B which are formed by a stamping operation. Each end of the heat exchange tube B is inserted through the slot F and soldered to the header pipe to prevent leakage of coolant.

As shown by the arrows in FIG. 5, coolant flows from header pipe A through the upper three tubes B to the other pipe C and, thence, returns through the intermediate three tubes B to pipe A, and then from pipe A through lower three tubes B to pipe C. As coolant flows through the condenser in a meandering and sinuous fashion it is pressurized and caused to undergo forced heat radiation, converting it into cooled liquid at low temperature and under high pressure. Heat radiated at this time is transmitted from tubes B to corrugated fins D (hereinafter referred to as fins) to be dissipated by air supplied to fins D.

In forming the slots F, by a stamping operation, as shown in FIG. 6, edges G of each slot F is depressed such that peripheral wall H of the header tube, between adjacent slots F, is deformed to form an outwardly projected dome, and the inlet portion Y of slot F is broadened to facilitate the insertion of heat exchange tube B.

PROBLEMS IN THE PRIOR ART

As seen in FIG. 6, a coolant condenser is formed by inserting heat exchanging tubes B into the slots F of oppositely positioned header pipes A and securing a longitudinal row of corrugated fins D in one-point contact with dome-shaped portion of the peripheral wall H of the header pipe A. Therefore, the fins D are loosely held and are likely to be shifted prior to the time they are soldered to the heat exchange tubes B. In addition, the efficiency of heat transfer from the header pipe A to fins D is likely to be harmed, reducing the heat radiation efficiency of the overall coolant condenser.

OBJECT OF THE INVENTION

An object of the invention is to provide a header pipe which permits ready insertion of the heat exchange tubes and where the radiation fins are subject to less deviation so that high heat radiation efficiency results.

SUMMARY OF THE INVENTION

According to the present invention, there is provided a header pipe which, as shown in FIGS. 1 and 2, has two or more tube insertion slots 3 formed in its peripheral wall 2 and which peripheral wall 2, between adjacent tube insertion holes 3, has a W-shaped longitudinal profile forming a depressed portion 4 and outwardly projecting support portions 5 on the opposite sides of depressed portion 4.

DETAILED DESCRIPTION OF THE INVENTION

Figure 1:
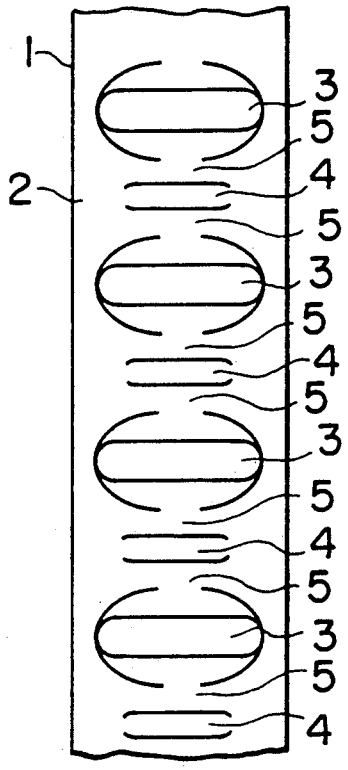
FIG. 1 is a front elevational view of a header pipe embodying the present invention.
Figure 2:
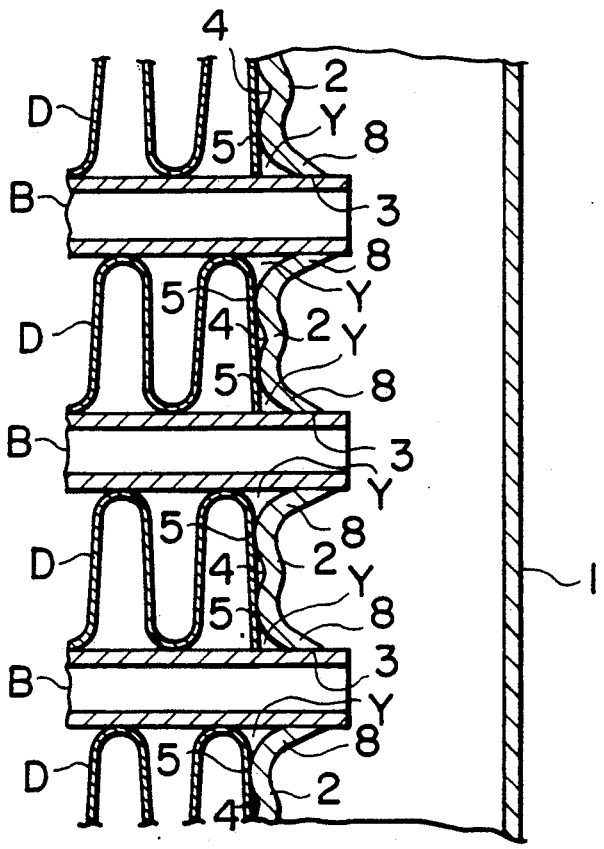
FIG. 2 is a sectional view of the header pipe of FIG. 1, illustrating the mounting of the header tubes and fins.
Figure 4:
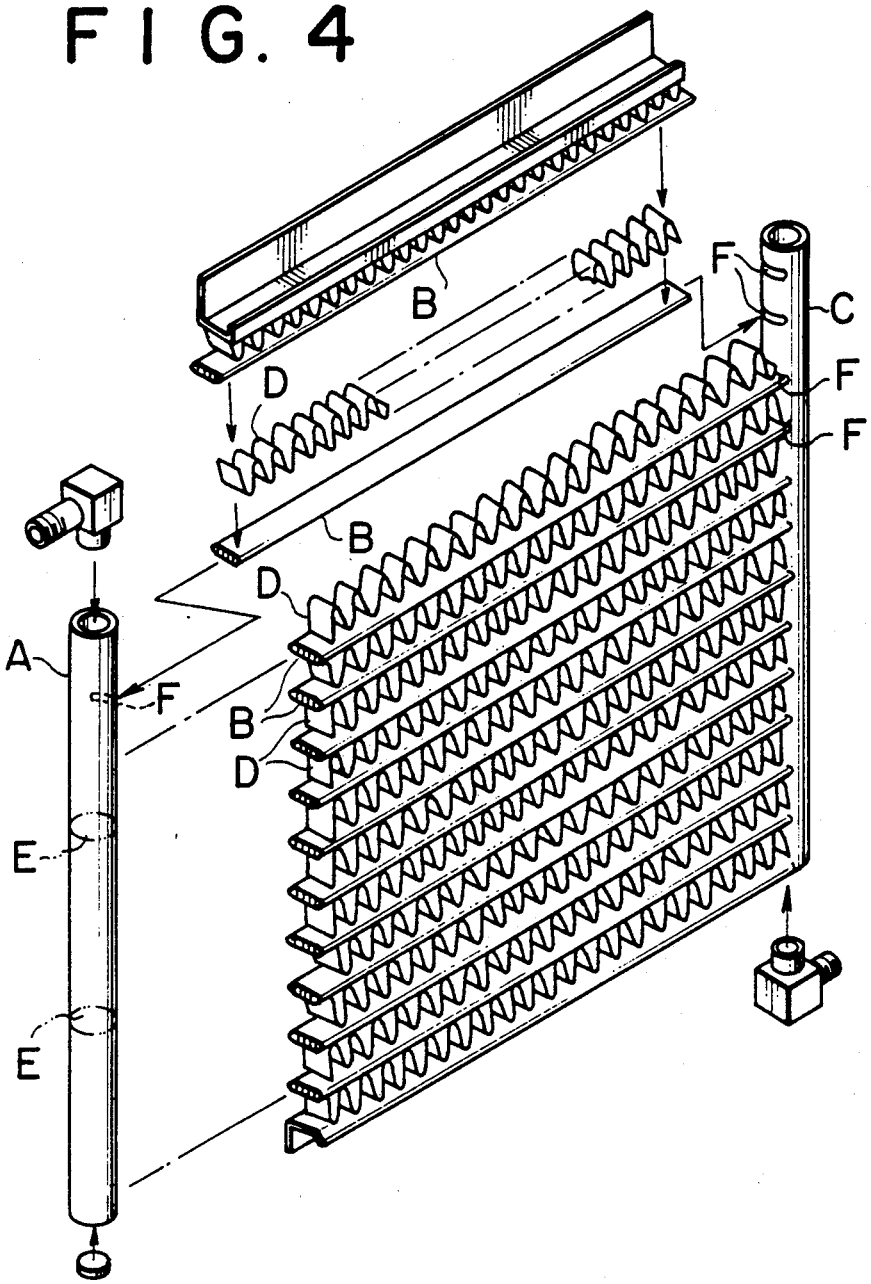
FIG. 4 is a perspective exploded view of a prior art coolant condenser.
Figure 5:
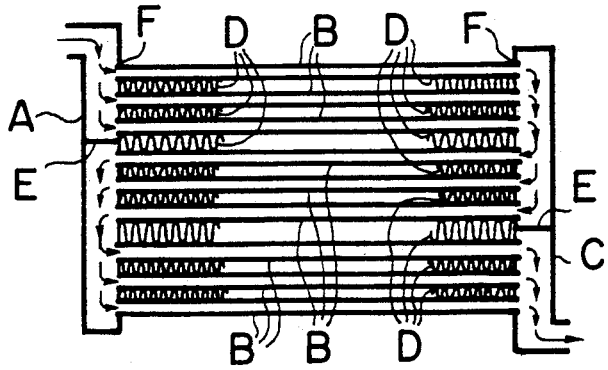
FIG. 5 is a diagrammic view explaining the flow of coolant in the coolant condenser of FIG. 4.

Referring to FIGS. 1 and 2, a header pipe body 1 is formed with a peripheral wall 2, which is provided with tube insertion slots 3 made by stamping. When forming the tube insertion slots 3, the edges 8 of each slot 3 is depressed to provide broadened funnel-like inlet portion Y to facilitate the insertion of the heat exchange tubes B.

In accordance with the present invention, the header pipe is formed with a W-shaped profile in longitudinal cross section. Laterally elongate depressed portions 4 are formed in peripheral wall 2 between adjacent tube insertion slots 3. Additionally, support portions 5 are formed, straddling on the opposite side of each depressed portion 4, which will serve to support the opposite ends of the corrugated fins D located between the adjacent heat exchange tubes B. Such support 5 makes two-point contact with the ends of the fins.

When the depressed portions 4 are stamped simultaneously with the formation of tube insertion slots 3, the opposite side support portions 5 are also simultaneously formed since both are formed transversely to the longitudinal axis of the pipe.

Figure 3:
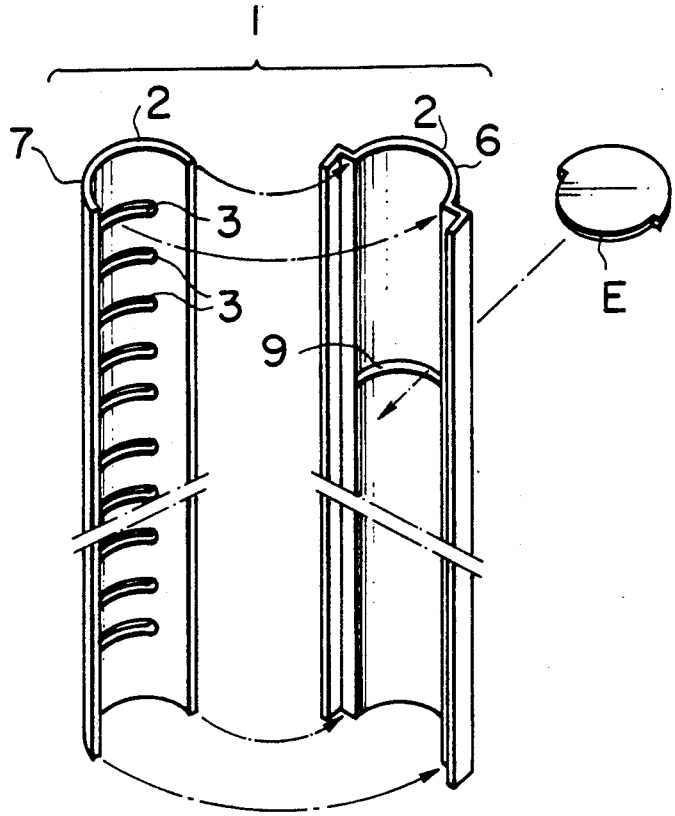
FIG. 3 is an exploded perspective view illustrating the manner of assembling a header pipe embodying the present invention.
Figure 6:
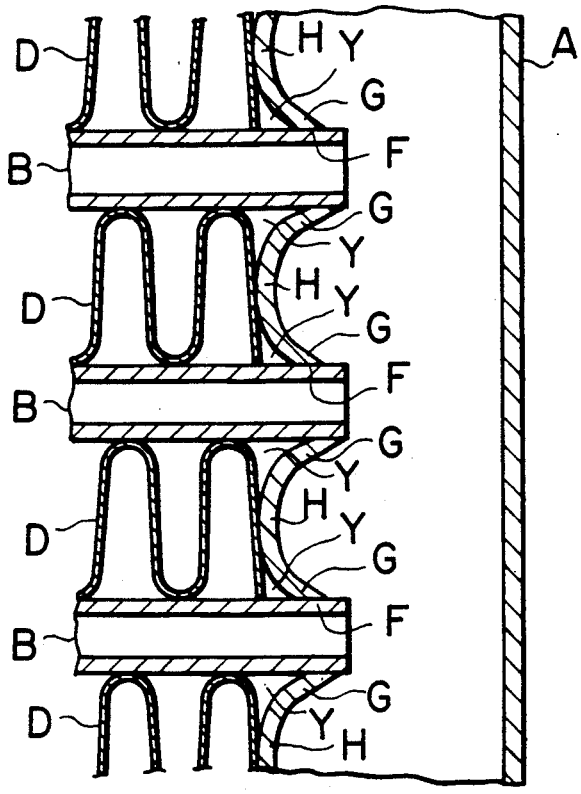
FIG. 6 is an enlarged sectional view of portion of the prior art coolant condenser.

As seen in FIG. 3, it is possible to form tube insertion slots 3, depressed portions 4, and support portions 5, by first forming the head pipe body 1 of a longitudinally split pipe forming halves 6 and 7. The split halves 6 and 7 are easily stamped with the inventively formed slots 3 and the slits 9 for receiving the partitioning plates E. Upon joining, soldering, or welding the two halves together, while at the same time securing the plates E, a complete header pipe can be formed.

USE OF THE INVENTION

According to the invention, the heat exchange tubes B are inserted into tube insertion slots 3, and subsequently, fins D are disposed between adjacent tubes B and supported at their lateral end by the support portions 5 formed in the header pipe bodies 1. Thereafter, pipe bodies 1, tubes B, and fins D are soldered or otherwise secured together to form the coolant condenser. In this case, solder may be applied in advance to portions of pipe bodies 1, tubes B, and fins D, and by heating header pipes 1, the solder will be fused to effect fixed soldering.

Further, since with the header pipe according to the invention has a peripheral wall 2 which is formed with depressed portions 4 and straddling portions 5, the laterally opposite ends of fins D are each in two-point contact with support portions 5 at each end of the corrugation. Therefore, fins D are stabilized and less likely to be shifted before completion of the soldering operation.

Further, since individual fins D are in two-point contact with a pair of support portions 5, heat transfer from the header pipe body 1 to the fins D is improved and heat transfer is more efficient.

ADVANTAGES OF THE INVENTION

The pipe for a coolant condenser according to the present invention has the following advantages:

1) Since support portions 5 are formed on the opposite sides of depressed portion 4 between adjacent tube insertion holes 3, the opposite ends of fins D, between adjacent tubes B, are in two-point contact with the header pipe body and are thus less liable to deviation.

2) Since each end of each fin D is in two-point contact with a pair of support portions 5, the efficiency of heat transfer from pipe body 1 to fin D is improved compared to the prior art, thus improving the cooling efficiency of the overall coolant condenser.

3) Since air can pass through the gap between depressed portion 4 and fin D, the heat dissipation efficiency is improved, increasing the cooling efficiency of the overall coolant condenser.

4) Since pipe body 1 is formed with depressed portions 4, the mechanical strength of pipe body 1 is improved.

We claim:

1. In a coolant condenser having a pair of header pipes spanned by a plurality of heat exchange tubes having ends adapted to be inserted in slots in said header pipes and corrugated fins arranged between adjacent heat exchange tubes, the improvement wherein the wall sections of the header pipe, between adjacent slots, has a W-shaped profile in longitudinal cross section, having a central depressed portion straddled by a pair of projecting portions such that said projecting portions engage and support the adjacent end surface of said corrugated fins.

2. The improvement according to claim 1, wherein said header pipe is formed of two longitudinal halves, said halves being stamped and provided with partitioning plates prior to securing said halves together.

3. The improvement according to claim 1, wherein said depressed and projecting portions are disposed transversely to the longitudinal axis.

* * * * *